US010037746B2

(12) United States Patent
Priede

(10) Patent No.: US 10,037,746 B2
(45) **Date of Patent: *Jul. 31, 2018**

(54) SYSTEM AND METHOD FOR DISPLAYING LAYERED IMAGES

(71) Applicant: CHRISTIE DIGITAL SYSTEMS USA, INC., Cypress, CA (US)

(72) Inventor: Jordan Evalds Huxley Priede, Waterloo (CA)

(73) Assignee: CHRISTIE DIGITAL SYSTEMS USA, INC., Cypress ( * ) Notice: Subject to any disclaimer, the term of this patent is extended or adjusted under 35 U.S.C. 154(b) by 0 days.

This patent is subject to a terminal disclaimer.

(21) Appl. No.: 15/679,293

(22) Filed: Aug. 17, 2017

(65) Prior Publication Data

US 2018/0018942 A1 Jan. 18, 2018

Related U.S. Application Data

(60) Continuation of application No. 15/411,461, filed on Jan. 20, 2017, now Pat. No. 9,773,475, which is a division of application No. 14/175,500, filed on Feb. 7, 2014.

(51) Int. Cl.
*G09G 5/12* (2006.01)
*G09G 3/00* (2006.01)

(52) U.S. Cl.
CPC ..... *G09G 5/12* (2013.01); *G09G 3/003* (2013.01); *G09G 2300/023* (2013.01); *G09G 2310/0237* (2013.01); *G09G 2320/0646* (2013.01)

(58) Field of Classification Search
CPC ..... G09G 3/003
See application file for complete search history.

(56) References Cited

U.S. PATENT DOCUMENTS

| | | | | |
|---|---|---|---|---|
| 8,116,937 | B2 * | 2/2012 | Kumon | B60K 35/00 340/425.5 |
| 8,624,797 | B2 * | 1/2014 | Lee | G06F 1/1649 345/1.1 |
| 9,773,475 | B2 * | 9/2017 | Priede | G09G 5/12 |
| 2004/0029636 | A1 * | 2/2004 | Wells | G07F 17/3211 463/32 |
| 2010/0097293 | A1 | 4/2010 | McMahon | |

(Continued)

*Primary Examiner* — Dorothy Harris
(74) *Attorney, Agent, or Firm* — Perry + Currier

(57) ABSTRACT

A system and method for displaying layered images is provided. A rear display element displays a first image including a background. A transmissive display element displays a third image and a fourth image, the third image being displayed contemporaneously with the first image. The transmissive display element has a front surface and a rear surface. The rear surface is placed a predetermined distance from the rear display element such that images displayed by the rear display element and by the transmissive display element can be viewable through the front surface of the transmissive display element. A lighting element provides backlight illumination to the transmissive display element contemporaneously with the fourth image. The lighting element can provide the backlight illumination by having the system display a second image at the rear display element for transmitting a backlight illumination from the rear display element contemporaneously with the fourth image.

12 Claims, 14 Drawing Sheets

(56) References Cited

U.S. PATENT DOCUMENTS

| | | | | |
|---|---|---|---|---|
| 2011/0298935 | A1* | 12/2011 | Segal | H04N 5/2222<br>348/207.1 |
| 2012/0113140 | A1* | 5/2012 | Hilliges | G06F 3/011<br>345/633 |
| 2012/0188279 | A1* | 7/2012 | Demaine | A63F 13/10<br>345/633 |
| 2012/0188637 | A1 | 7/2012 | Joseph et al. | |

* cited by examiner

SYSTEM AND METHOD FOR DISPLAYING LAYERED IMAGES

CROSS-REFERENCE TO RELATED APPLICATION

This application is a continuation of U.S. application Ser. No. 15/411,461, filed Jan. 20, 2017, which is a division of U.S. application Ser. No. 14/175,500, filed Feb. 7, 2014. The contents of the above-reference applications are incorporated herein by reference.

FIELD OF INVENTION

The present invention relates generally to layered display technology and more particularly to a system and method for displaying layered images based on a multi-layer displays and interleaving.

BACKGROUND

Images can be layered using various display technologies to achieve a layered image with the potential for the layered images to appear to be multi-planar and thus three-dimensional (3D) in nature in accordance with those planes. For example, in a system known as Pepper's Ghost, an angled sheet of glass is placed between the objects being viewed and a viewer, allowing an image to the side that is reflected by the glass to be layered on top of objects viewable through the glass. However, this system only allows for the addition of light by the layered image. Accordingly, the dark areas in the added image appear to be transparent, resulting with ghost-like images. Moreover, the reflected images require significant space due to reflection geometry. These images are also inherently deep within the display unit.

In another example, a transmissive liquid crystal display (LCD) panel can be used to add a layer of images to objects that are viewable behind the LCD panel. However, transmissive LCD panels only allow for subtraction of light for areas with content, thus making the added image layer to appear translucent in light colored areas. In a further example, transmissive OLED panels can be used to add a layer of images to objects that are viewable behind the OLED Panel. However, transmissive OLED Panels, similar to Pepper's Ghost, only allow for the addition of light, resulting in the dark areas of the added layer image to appear transparent and ghostlike. Accordingly, improved systems for displaying layered images are needed.

SUMMARY

It is an objective to provide a novel system and method for displaying layered images that obviates and mitigates at least one of the above-identified disadvantages of the prior art.

According to an aspect, a display system for providing layered images can be provided. The system can comprise: a rear display element for displaying a first image including a background; a transmissive display element for displaying a third image and a fourth image, the third image being displayed contemporaneously with the first image, the transmissive display element having a front surface and a rear surface, the rear surface placed a predetermined distance from the rear display element such that at least a portion of content displayed by the rear display element and by the transmissive display element are viewable through the front surface of the transmissive display element when content displayed by the transmissive element include transmissive areas; and a lighting element providing backlight illumination, the lighting element providing backlight illumination to the transmissive display element contemporaneously with the fourth image.

The display system can further comprise a synchronizer for synchronizing the display of images at the transmissive and rear display elements, wherein the synchronizer can further synchronizes the lighting element such that the lighting is off during image transitions at the transmissive and rear display elements. The display system can further comprising a camera for capturing images of objects located proximal to the front surface of the transmissive display element. The display system can also comprise a synchronizer for synchronizing the transmissive and rear display elements, the lighting element and the camera such that the camera is turned off while the backlight illumination is turned on.

The display system can comprise a transmissive sheet placed at an angle between the back surface of the transmissive display element and the front surface of the rear display element such that the camera receives, through a reflection off of the transmissive sheet, images of objects located proximal to the front surface of the transmissive display element and the rear display element is viewable through the front surface of the transmissive display and through the transparent sheet.

The lighting element can be a backlight for the rear display element and the backlight illumination can be provided to the transmissive display element, contemporaneously with the fourth image, by displaying a second image at the rear display element for transmitting illumination from the backlight to the transmissive display element. The predetermined distance can allow insertion of objects between the transmissive display element and said rear display element.

The transmissive display element can be at least one of sized or positioned with respect to the rear display element such that a content displayed as part of the third image, when viewed from the front surface of the transmissive display element, can be within the boundaries of the first image.

According to another aspect, a method of providing layered images can be provided. The method can comprise: displaying a first image including a background at a rear display element; displaying a third image at a transmissive display element, the third image being displayed contemporaneously with the first image; displaying a fourth image at the transmissive display element, at least a portion of content displayed at the rear display element and at the transmissive display element being viewable through a front surface of the transmissive display element in an overlaid manner, when content displayed at the transmissive display element includes transmissive areas; and providing a backlight illumination for said transmissive display element contemporaneously with the fourth image.

The fourth image can include a content area. The third image can include transparency information. The third image can further include a content mask, the rest of the third image being a transmissive area. The content mask can be formed in an image area based on the content area included in the fourth image. The content mask can also include opaque areas.

The transmissive display element can be a transmissive liquid crystal display (LCD) panel, the content mask being displayed as black, and the transmissive area being displayed as a light area. The content area can be opaque and cover the entire image area of the fourth image. The third image can include a transmissive area and the fourth image can include a surround mask outside of the content area. The surround mask can be opaque.

Providing a backlight illumination for the transmissive display element can comprise displaying a second image at the rear display element for transmitting a backlight illumination from the rear display element contemporaneously with the fourth image. The transmissive display element can be a transmissive LCD and the second image can be a white image.

These, together with other aspects and advantages which will be subsequently apparent, reside in the details of construction and operation as more fully hereinafter described and claimed, reference being had to the accompanying drawings forming a part hereof, wherein like numerals refer to like parts throughout.

DETAILED DESCRIPTION

Implementations described herein are directed toward layered display systems that include layered display elements so that a viewer may perceive depth or the 3D effects in the displayed images without the use of 3D glasses or eyewear. The layered display systems described may be thought of as multi-plane systems as a typical implementation will include two or more display elements that are used to display foreground and a rear or background content and intermediary images as necessary. Layering and interleaving of images and image areas can be used to achieve an improved layered display system where the foreground content can be selectively given desired perceived transmissive and emissive properties. Accordingly, using different layering and interleaving combinations of images containing specific opaque, transparent and translucent areas, the layered display systems can selectively cause foreground content to appear as transparent, translucent, opaque, or emissive thus allowing selective conveyance of different visual effects.

Figure 1:
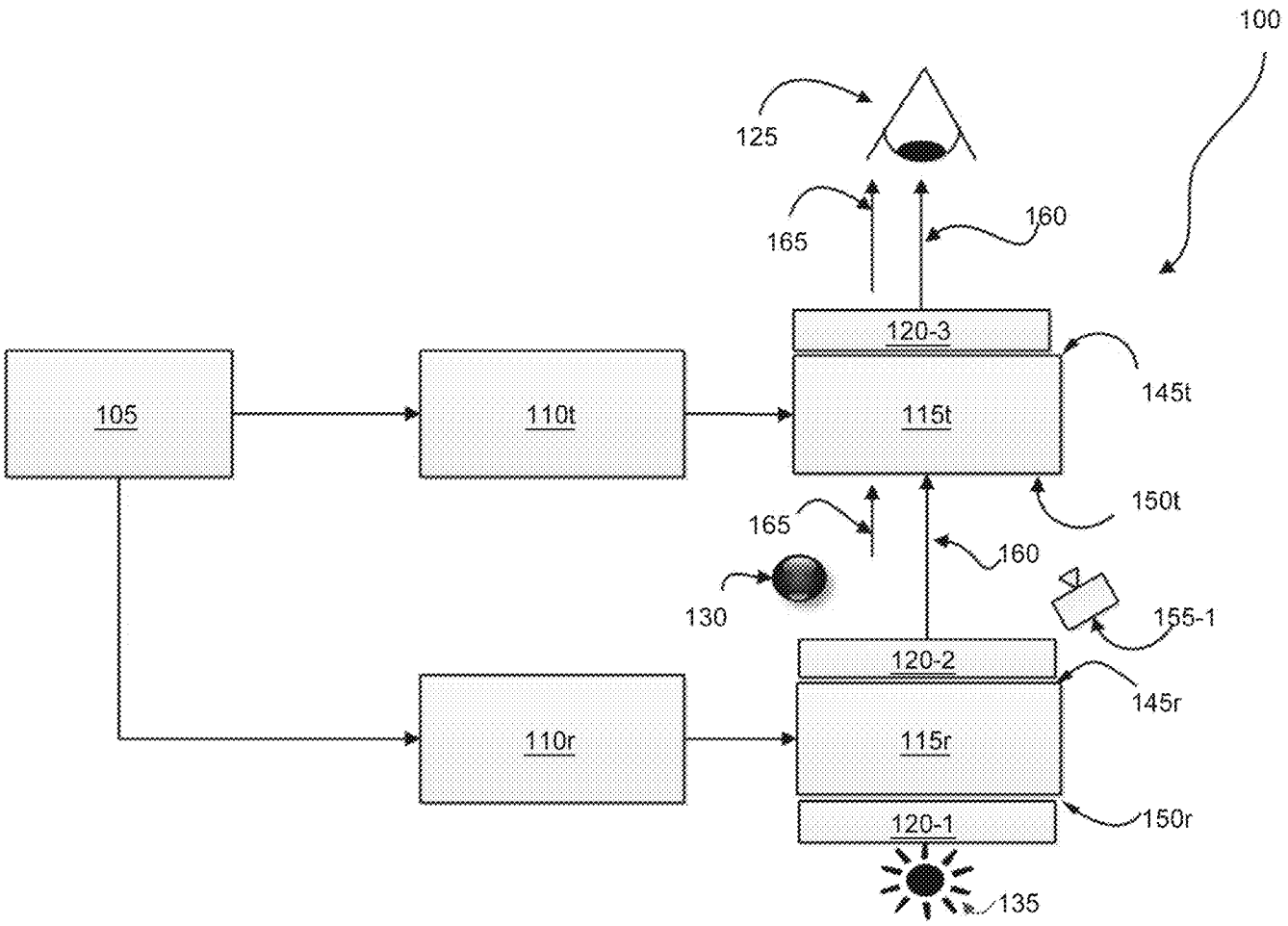
FIG. 1 shows a block diagram of an implementation of a display system for providing layered images.

Referring now to FIG. 1, a diagram of a display system 100 for generating layered images in accordance with an example implementation is shown. The example system 100 includes a rear display element 115*r* and a transmissive display element 115*t*. Collectively, display elements 115*r* and 115*t* are referred to as display elements 115, and generically as display element 115. This nomenclature is used elsewhere herein. In this example implementation, both display elements 115 are transmissive LCDs, although in other implementations, different display elements can be used. For example, transmissive display element 115*t* can be any partially translucent or transparent display that will now occur to a person of skill that is capable of modulating its transmissive properties to display opaque, translucent or transparent areas at a predetermined or variable rate. The rear display element 115*r* can be any partially translucent or transparent display, an LCD display, and AMOLED display, a front or rear projection screen such as screens for liquid crystal on silicon (LCOS) or digital light processing (DLP) or others that will now occur to a person of skill.

Two-dimensional (2D) images or content can be displayed on each of the display elements 115. Furthermore, each display element 115 can include a front surface 145, which is typically a display surface and a rear surface 150. Collectively, front surfaces 145*r* and 145*t* are referred to as front surfaces 145, and generically as front surface 145. Moreover, collectively, rear surfaces 150*r* and 150*t* are referred to as rear surfaces 150, and generically as rear surface 150.

The front surfaces 145 of each of the display elements 115 can be spaced apart and arranged, typically, to be in parallel planes (multiple display planes). The spacing can be achieved by placing the rear surface 150*t* of the transmissive display element 115*t* a predetermined distance from the front surface 145*r* of the rear display element 115*r*. Accordingly, a viewer 125 viewing images on the front surface 145*t* of transmissive display element 115*t* may be able to, based on conditions such as the lighting conditions and the content of the images displayed, view objects 130 and light sources placed between the two display elements 115. In this example, light sources include lighting element 135. It should be noted that the combination of different elements, components and objects discussed in this example is illustrative only, and that in other implementations, various components and objects can be omitted. For example, in implementations where the rear display element 115*r* is transmissive, objects, light sources and cameras could be placed behind the rear surface 150*r*. In other variations, object 130 or camera 155 can be omitted. Other configurations for system 100 will now occur to a person of skill.

Continuing with FIG. 1, example system 100 includes an image generator 105. Image generator 105 can be based on any type of device that is suitable for producing and/or providing images such as a computing environment, a video processor, a recorded image player such as a Blue-ray Disc™ player and others that will now occur to a person of skill. Images supplied by the image generator 105 are provided to display drivers 110*r* and 110*t*, for example in the form of video feeds. Collectively, display drivers 110*r* and 110*t* are referred to as display drivers 110, and generically as display driver 110. Display drivers 110 buffer the image and provide it to a display element 115. Transmissive display driver 110*t* receives one or more image or video feeds destined for transmissive display element 115*t* and provides the received feeds to transmissive display element 115*t*. Rear display driver 110*r* receives one of more feeds destined for rear display element 115*r* provides the feeds to rear display element 115*r*. In variations, one or both display drivers 110 may be able to interleave the provided feeds prior to providing them to the display elements 115. For example, in some implementations, image generator 105 may provide one front video feed to display driver 110*t* that includes foreground content interleaved with transparency information generated based on the foreground content. Transparency information can include information regarding transmissiveness of pixels in the foreground content (for example, whether each pixel in a given image containing the foreground content is transparent, translucent—and the degree of translucence—or opaque). In other implementations, two front feeds may be provided to display driver 110*t*, one feed containing the foreground content and another feed the transparency information for the foreground content. In these implementations, the driver 110*t* can interleave the two feeds such that the images provided to transmissive display element 115*t* consists of interleaved foreground content and transparency information for the foreground content. In yet other implementations one rear feed can be provided to the rear display driver 110*r* where the rear feed includes background content interleaved with white images. In further implementations, the rear feed can only include background images, the panel driver 110*r* generating and interleaving the white content.

Other variations in providing feeds, and interleaving content for provision to the display elements 115 will now occur to a person of skill. For example, interleaved feeds can be provided as a single feed, the single feed alternating images of the two feeds. Alternatively, interleaved images can be provided in a single feed in an interlaced manner where each interleaved feed is provided on every other line of the image of the single feed. In yet other alternatives, two images to be interleaved can be provided as part of a single image in the single feed, the two images taking up one half of the single image of the feed. As it can be appreciated, some of these methods can involve loss of resolution for the interleaved images.

In some implementations, a synchronizer (not shown) can also be included as part of system 100. The synchronizer used would allow synchronization of the two display elements 115 such that each image received at the two display elements 115 is displayed contemporaneously, in a synchronized manner. Moreover, in variations, the synchronizer can also be used to synchronize the lighting element 135 with the display elements 115. In further variations the synchronizer can also control one or more cameras 155 such that their operation is also synchronized with the display elements 115 and the lighting element 135.

In some implementations, in order to synchronously display two video feeds destined to display elements 115, two frame buffers can be used for each display driver 110*t* and 110*r* (one to read, one to write). In variations, four buffers can be used for each display driver, two to read from and two to write to. For example, in implementations where two images are alternated sequentially, four buffers can be used. In further variations where synchronous video feeds are supplied to display drivers 110, it may be possible to use one frame buffer to read and write from. If three video feeds are provided, for example a first feed containing foreground content destined for display device 115*t*, a second feed containing transparency information for the content also destined for display device 115*t* and a third feed containing background content, then driver 110*t* can interleave the first feed and the second feed, and signal to driver 110*r* when to display the third feed, and when to display white images, which can be automatically generated by driver 110*r*. In other implementations two video feeds can be used, one feed, a front feed, being a frame-interleaved feed destined to transmissive driver 110*t* and containing foreground content interleaved with an alpha channel containing transparency information of the front color images, the other feed, a rear feed, being a frame interleaved feed being destined for rear driver 110*r*, and containing background content interleaved with white images. In these cases, display drivers 110 would determine which frame of the front feed is content, and which is transparency information as well as which frame of the rear feed is background content and which is white content to enable synchronization of the two feeds. In variations, interleave enabled display drivers can be used that include a sync signal, to declare which frame is foreground content and which frame is transparency information, for example, the sync signals being adopted to control the synchronization of feeds in system 100. Other variations in identifying interleaved content and synchronizing feeds will now occur to a person of skill.

Figure 2:
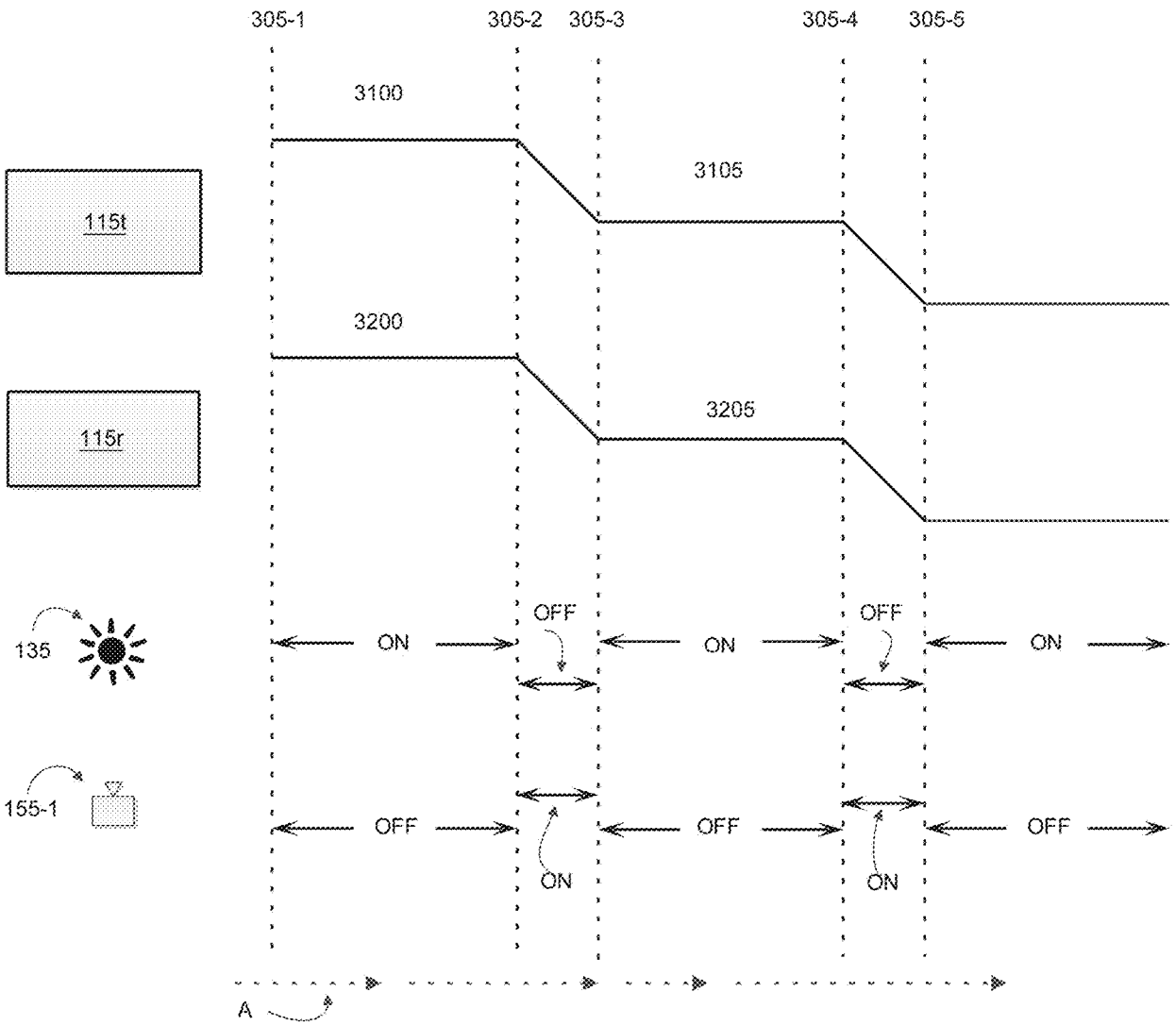
FIG. 2 shows a timeline chart showing a method of synchronization in accordance with an implementation.

Referring to FIG. 2, an example method of synchronizing two display elements 115, a lighting element 135 and a camera 155-1 is shown. FIG. 2 shows a simplified timeline for the operation of each of the components. The timeline shown is not to scale but rather, duration of events have been chosen to better illustrate the operation of the synchronizer. Progress of time is shown along the horizontal axis indicated with A. The synchronization events in time are indicated at 305. At event 305-1 an image, $1^{st}$ image 3200, is displayed at the rear display element 115*r* and another image, $3^{rd}$ image 3100 is displayed at the transmissive display element 115*t*, the images being displayed contemporaneously, in a synchronized manner. Also at event 305-1 the lighting element 135 is turned on, and the camera 155-1 is turned off. At event 305-2, display elements 115 are provided with new images, and the transition to display the new images starts contemporaneously, in a synchronized manner. Also at event 305-2 the lighting element 135 is turned off, and the camera 155-1 is turned on. At event 305-3 the transition is complete and $2^{nd}$ image 3205 is displayed at the rear display element 115*r* and another image, $4^{th}$ image 3105 is displayed at the transmissive display elements 115*t* contemporaneously. Also at event 305-3 the lighting element 135 is turned on, and the camera 155-1 is turned off. At event 305-4, display elements 115 are provided with new images, and the transition to display the new images contemporaneously starts. Also at event 305-4 the lighting element 135 is turned off, and the camera 155-1 is turned on. At event 305-5, a single display cycle is complete. In one implementation, this cycle can be repeated at high frequency to minimize visual artifacts. Although the timeline shown ends when images 3105 and 3205 are displayed contemporaneously, it is to be understood that system 100 can continue operate to display many more images in this synchronized, cyclical manner. Accordingly, cycles can be display at various frequencies. For example, a 120 Hz display system can display up to 120 images a second, whereas a 240 Hz display system can display up to 240 images a second. Thus, a cycle comprising of the event sequences equivalent to 305-1, 305-2, 305-3 and 305-4 can occur 60 times per second for a 120 Hz display system and 120 times per second for a 240 Hz display system. The frequencies discussed are for illustrative purposes only, and in variations different frequencies of operation are possible. In further variations, the manner of synchronizing used in the system and for different components of the system can change at any point in time during the provision of feeds.

By turning off the lighting element during periods of display element 115 transition, the images can be perceived, by a viewer 125, to be clearer. By turning the camera on only when the lighting element 135 is off, interference of the lighting element 135 with the cameras sensors can be reduced. For high frequency display systems, cameras with a highly sensitive sensor or large aperture lens, or a combination of the two can be used to account for the short operation times.

It will now be apparent to a person of skill that other means for achieving synchronization is possible. For example, in some implementations the display elements 115 used can be matched as closely as possible by choosing display elements 115 with similar frame delays or by calibrating the display elements 115, and/or providing images from the display driver in such a manner that the image display periods on the display elements 115 are as closely synchronized as possible without the use of a synchronizer. Other methods of synchronization will now occur to a person of skill.

Referring back to FIG. 1, lighting element 135 can be in the form of different light sources such as light emitting diode (LED), cold cathode fluorescent lamp (CCFL) and others that will now occur to a person of skill. In variations, lighting element 135 can comprise a combination of two or more light sources located proximally or distributed in or proximal to display elements 115. In some variations, lighting element 135 can provide backlight illumination to rear display element 115*r* (as in this illustrative example). In variations, where the rear display element 115*r* is an LCD panel for example, the lighting element 135 can be an integral part of rear display element 115*r*. In implementations where the rear display element 115*r* is a projection screen, the lighting element 135 can take the form of light sources for the projection. In other variations, additional light sources can be provided to illuminate the space between the display elements 115. Other forms, combinations and placements of lighting element 135 will now occur to a person of skill.

Continuing with FIG. 1, light generated by light sources such as lighting element 135 can travel through different paths and multiple components of system 100 before reaching a viewer 125. Once such light path, path 160, is illustrated in FIG. 1. According to path 160, light generated by light element 135 travels first through the rear display element 115*r*, then through the transmissive display element 115*t* before reaching a viewer 125. Ambient light from sources other than lighting element 135, can also travel through the same path 160 or through or other light paths such path 165 for example. The perceptibility of light generated by sources other than lighting element 135 can be dependent on the relative brightness of other light sources in comparison to the brightness of lighting element 135.

In variations, light guides and other mechanisms for shaping the light and the light path can be used. For example, lighting element 135 can be placed at the sides of rear display element 115*r*, and the light can be transmitted to the rear display element 115*r* through side light guides. In variations, display system 100 can further include polarizers 120-1, 120-2, and 120-3 as indicated in the example implementation of FIG. 1. Collectively, polarizers 120-1, 120-2 and 120-3 are referred to as polarizers 120, and generically as polarizer 120. Specifically, in this example implementation, an intermediate polarizer 120-2 is indicated at the front surface 145*r* of the rear display element 115*r*, a rear polarizer 120-1 is indicated at the rear surface 150*r* of rear display element 115*r* and a front polarizer 120-3 is indicated at the front surface 145*t* of transmissive display 115*t*. Moreover, different polarizers can have different orientations. For example, polarizer 120-1 at the rear surface 150*r* of rear display element 115*r* could have a horizontal orientation and polarizer 120-3 could have a vertical orientation. Alternatively, polarizer 120-1 could have a vertical orientation and polarizer 120-3 could have a horizontal orientation. As a further alternative, the directions can be at + or −45 degrees. Other arrangements of polarizer 120 orientation will now occur to a person of skill.

In variations, other combination or placements of polarizers can be used. For example, a fourth polarizer can be added at the rear surface 150*t* of the transmissive display element 115*t*, for example, when using projection based rear panel 115*t*. In these variations, the two polarizers 120 between the two display elements 115 could be in the same orientation, such as horizontal. As a further example, in some implementations intermediate polarizer 120-2 can be located at the rear surface 150*t* of the transmissive display element 115*t* as opposed to at the front surface 145*r* of the rear display element, thus allowing content displayed at 115*t* to be viewable by a viewer 125, multiplied over object 130 in a transmissive manner. To enhance the visibility of object 130, lighting element 135 can include additional light sources for illuminating the space between the two display elements 115. In further variations, polarizers can be integral to one or both of the display elements 115. In yet further variations of system 100, a diffuser (not shown) can also be located at the front surface 145*r* of rear display element 115*r*. It should be noted that in preferred implementations, all components of front display element 115*t* are non-diffuse to enable viewing content behind it.

A layered display system can also include one or more cameras. Continuing with FIG. 1, example system 100 includes a camera 155-1 as shown. In other implementations multiple cameras in different locations can be used. In one implementation, camera 155-1 can capture images of objects proximal to the front surface 145*t* of transmissive display element 115*t*, such as viewer 125. The captured images can then be processed to track the movements of the objects, such as gestures of the viewer 125. The captured images can be displayed on the display system 100, can be recorded for future display or can be transmitted to other display systems for further processing and display at those other display systems (mechanisms for processing, storing and transmitting images are not shown). In some implementations, camera 155-1 can be placed at the edge of, or adjacent to the display elements 115. In further implementations, a microphone for capturing sounds can also be included. The sounds can also be processed, recorded or transmitted.

Figure 3:
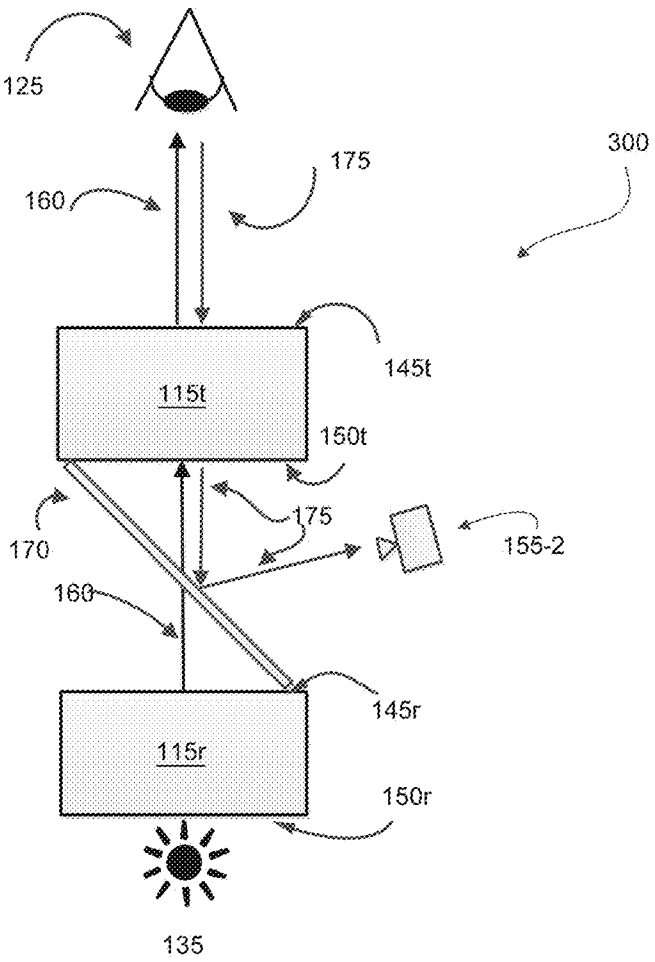
FIG. 3 shows a block diagram of an implementation of a display system for providing layered images.

Another example of an edge placed camera 155-2 is shown in FIG. 3 which indicates another implementation of a display system at 300. A transmissive sheet 170 of glass, Plexiglas™, film or other material at least partially reflective, and translucent or transparent can be placed between the transmissive display element 115*t* and rear display element 115*r* at an angle. Thus, in one implementation, transmissive sheet 170 can be placed, at an angle, between the front surface 145*r* of the rear display element 115*r* and the rear surface 150*t* of the transmissive display element 115*t*. Accordingly, the camera can receive, through a reflection off of the transparent sheet, as indicated by light path 175, images of objects such as viewer 125, located proximal to the front side of the transmissive display element 115*t*.

Moreover, the rear display element 115*r* can be viewable through the front surface 145*t* of the transmissive display 115*t* and through the transparent sheet 170, as indicated by light path 160.

Referring back to FIG. 2 and FIG. 1, the light path 160, amongst others, along with the contemporaneous display of images at both display elements 115 can allow a viewer 125 to perceive two different images generated by the two display elements 115 as being layered in two planes in 3D, with the image generated by the transmissive display element 115*t* being layered in front of the image generated by the rear display element 115*r*. In variations where the rear display element 115*r* is transmissive, the rear display element 115*r* may not display an image, or may only display an image in a portion of the display area, allowing a brightly lit background, formed by objects behind the rear display device 115*r*, for example, to be viewed at least as part of the background layer.

Layering two different images can produce different resulting perceived images based on the properties of the display used. In general, displaying, at a pixel, a color that is rendered as opaque by the transmissive display element 115*t* would allow only that color to be visible to a viewer 125 for that pixel. In contrast, displaying, at a pixel, a color that is rendered as transparent by the display element 115*t*, would allow viewer 125 to see the images rendered by rear display element 115*r*. Finally, displaying other colors that are translucent or partially transparent would allow a viewer to see a multiplicative blend of the colors displayed at the transmissive display 115*t* and rear display 115*r*, thus potentially giving the impression that the foreground colors are at least partially translucent.

Figure 4:
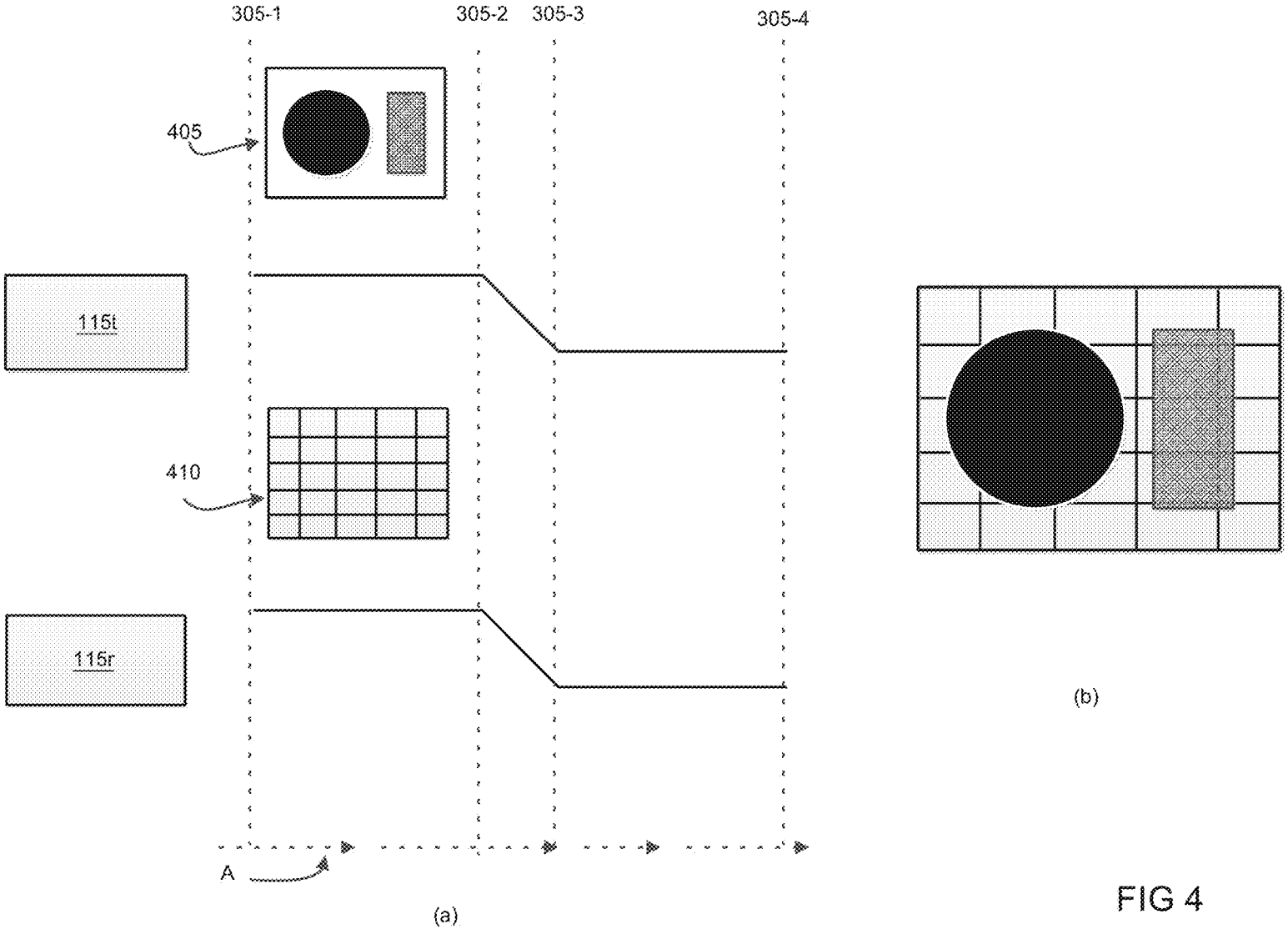
FIG. 4 shows a timeline chart showing a method of image layering in accordance with an implementation.

Referring now to FIG. 4, example of layering image 405 displayed at transmissive display element 115*t* with image 410 displayed at rear display 115*r* is shown. FIG. 4(*a*) shows an example method of displaying images 405 and 410 contemporaneously between events 305-1 and 305-2. FIG. 4(*b*) shows how the viewer 125 could perceive the images 405 and 410 based on the light path 160 shown in FIG. 1, for example. This result can be perceived since a transmissive LCD panel that is assumed to be used in this example implementation can render white portions of the image as transparent, and black portions of the image as opaque. Gray portions of the content, subsequently can appear translucent or partially transparent. Accordingly, where the image 405 is white, content of the rear image 410 can be viewed. Where the image 405 is black, only the black can be seen. Finally, where the image 405 is gray, contents of the rear image can be visible through the gray content.

Figure 5:
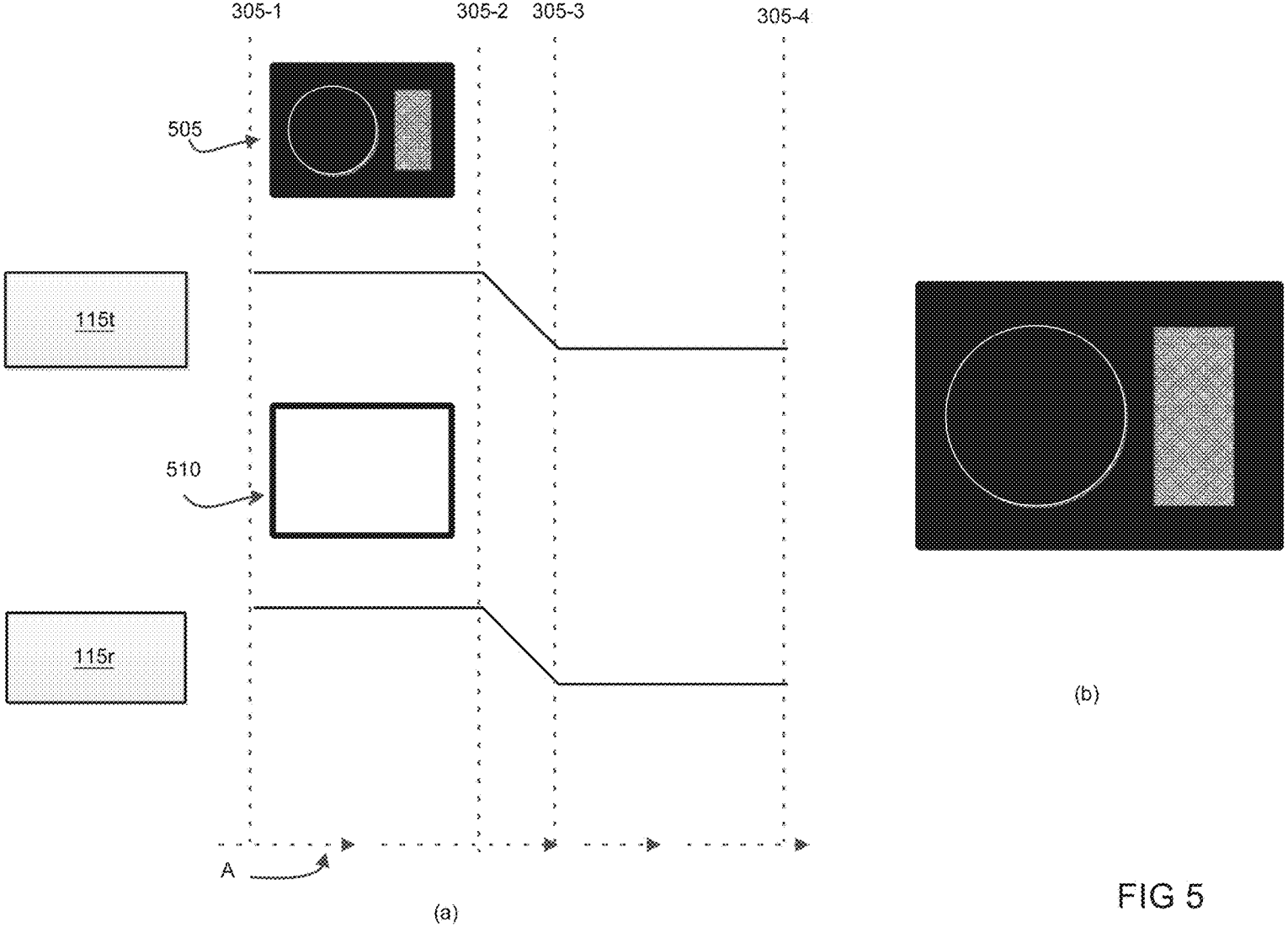
FIG. 5 shows a timeline chart showing a method of image layering in accordance with an implementation.

Referring now to FIG. 5, another example of layering two images is shown. In this case, image 505 is displayed at transmissive display element 115*t* and image 510 is displayed at rear display 115*r*. FIG. 5(*a*) shows an example method of displaying images 505 and 510 contemporaneously between events 305-1 and 305-2. FIG. 5(*b*) shows how the viewer 125 could perceive the images based on the light path 160 shown in FIG. 1, for example. This result can be perceived since displaying a white image at the rear display 115*r* has the same perceived effect on the images displayed by transmissive display 115*t* as a backlight illumination being provided at transmissive display 115*t*. Indeed, the same results could be achieved by turning on a light source significantly brighter than the light source illuminating the rear display element 115*r*, for example a light source placed in between the two display elements 115. Alternatively, a separate backlight for transmissive display 115*t* can be turned on.

Accordingly, any objects that are displayed in the transmissive display element 115*t* can be perceived as either transparent (where the object's colors match the transparent colors of the display, such as white in the case of a transmissive LCD display) or translucent or partially transparent (such as gray content for a transmissive LCD display). Accordingly, any foreground content displayed by the transmissive display element 115*t* that is not of opaque colors (black in the case of transmissive LCD panels) will not be perceived as solid and background content, such as those displayed by the rear display element 115*r*, will be viewable through the foreground content giving the foreground content a ghostly appearance.

Figure 6:
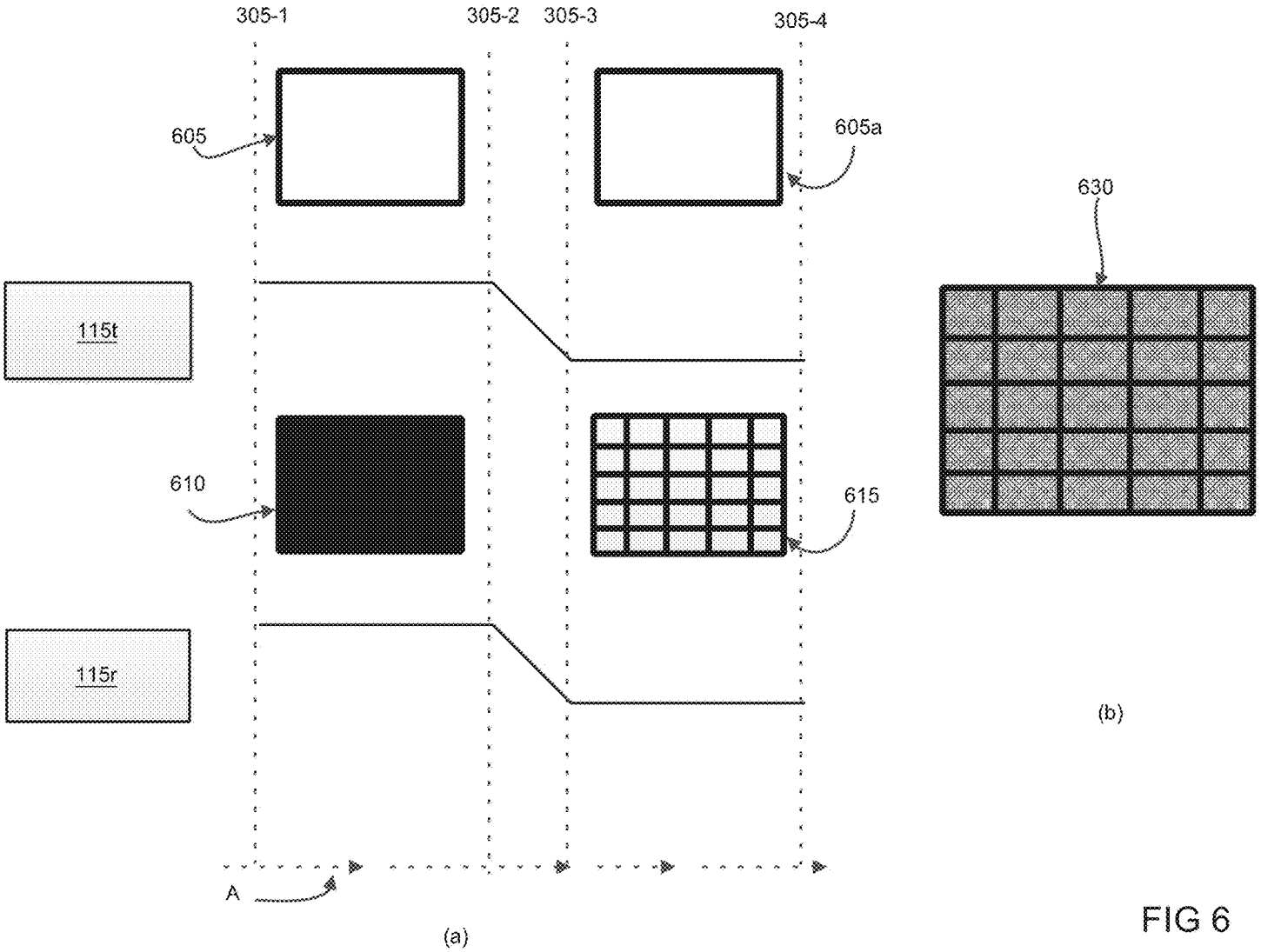
FIG. 6 shows a timeline chart showing a method of image layering in accordance with an implementation.

Images can also be interleaved as shown in an example in FIG. 6. When two images are interleaved, or alternated, a viewer's visual system integrates the resulting combination. Referring to FIG. 6(*a*), two images 610 and 615 are shown displayed in sequence at rear display element 115*r* in this example. Moreover, two white images 605 and 605*a* are shown, displayed in sequence by the transmissive display element 115*t*. Since in the example implementation of system 100 transmissive display element 115*t* is a transmissive LCD panel, displaying white images essentially renders the transmissive display element 115*t* transparent, allowing a viewer 125 to see images displayed by the rear display element 115*r*. FIG. 6(*b*) illustrates the resulting integration as seen by a viewer 125 based on light path 160 at 630, for example. As it can be seen, image 615 is perceived as being less bright since black from image 610 is being perceptually integrated by viewer 125 with the contents image 615.

The effects of layering and interleaving can be combined, as discussed below, to achieve an improved layered display system where the foreground content can be selectively given transmissive and apparent emissive properties based on the choice of interleaving and layering. Using different layering and interleaving content combinations the system can selectively allow foreground content to be perceived as partially translucent, transparent opaque or emissive thus allowing conveyance of different visual effects.

Figure 7:
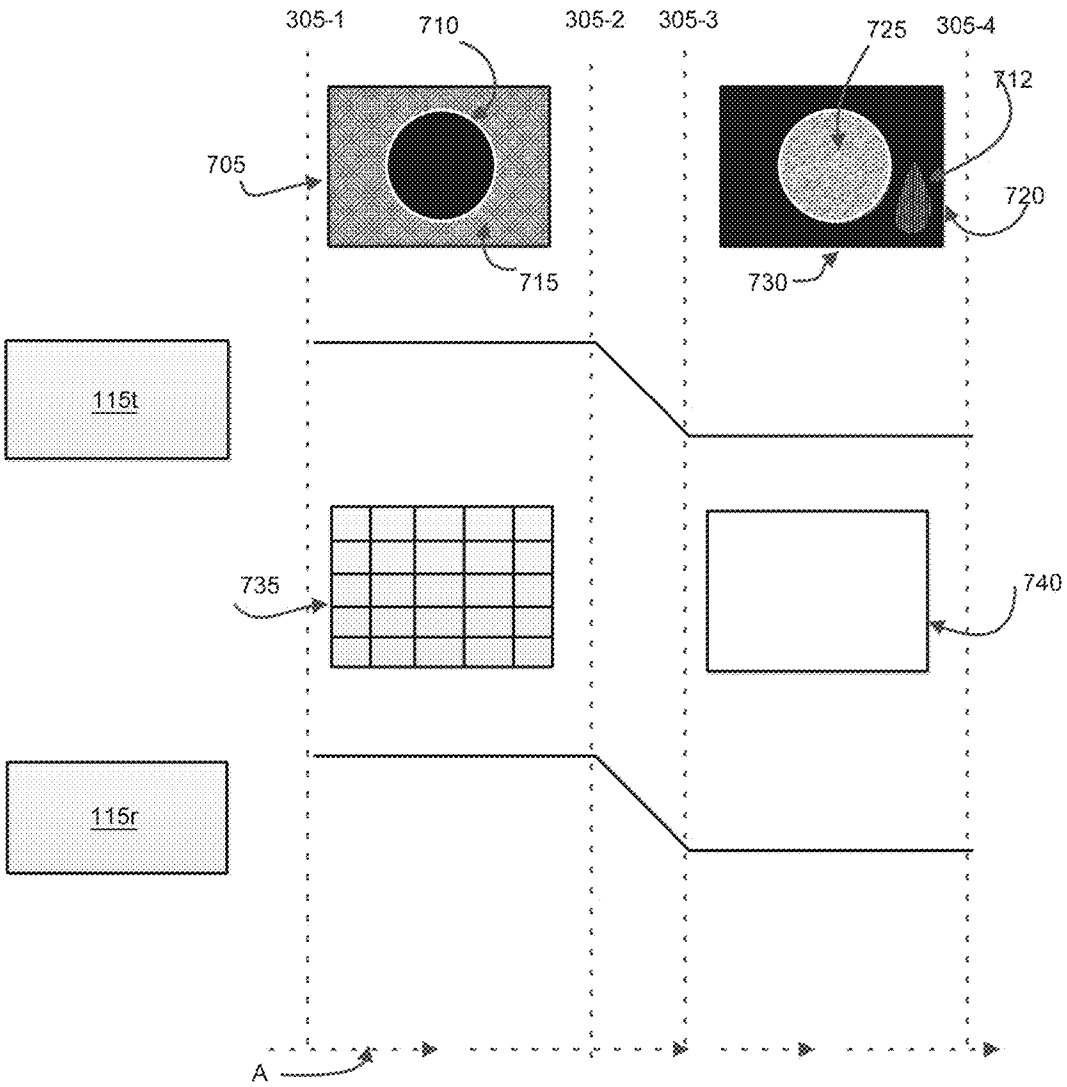
FIG. 7 shows a timeline chart showing a method of image layering in accordance with an implementation.

Referring to FIG. 7, an example of combining layering and interleaving to convey visual effects in a layered display system is shown. As shown, a 3rd image 705 and a 4th image 720 are displayed at transmissive display element 115*t* in sequence. The 3rd image 705 includes alpha information and contains a content mask 710, the rest of the third image being a translucent area 715. The 4th image 720 has a content area 725. The 4th image 720 also includes content area 712. The rest of the 4th image 720 is a surround mask 730. The content mask 710 is an image area based on the content area 725 included in the 4th image 720. In some implementations, the $3^{rd}$ image 705, or portions of it such as content mask 710 could be transparency information generated based on at least portions of the $4^{th}$ image 720 such as content area 725. In variations, the transparency information could be comprised of grayscale information. In further variations, the transparency information could have color information, and as such be available for red, green and blue (RGB) channels.

Continuing with FIG. 7, a 1st image 735 and a 2nd image 740 are displayed at rear display element 115*r* in sequence. 1st image 735 is an image of a background content and second image 740 is an image that enables transmitting a backlight illumination from the rear display element 115*r* to transmissive display element 115*t*, in this example a white image.

In this example, the content mask 710 and the surround mask 730 are opaque. Accordingly, since in this implementation, the transmissive display element 115*t* is a transmissive LCD panel, the surround mask 730 and the content mask 710 are displayed as black, and the transparent areas of 3rd image 705 are displayed as clear on the basis of a white video feed. A person of skill will now recognize that for different types of transmissive displays different colors may be displayed to achieve a desired opacity, transparency and emissive properties. The content 725 and 712 is displayed in accordance with the colors of the content to be displayed in that area.

As indicated in FIG. 7, 3rd image 705 is displayed at transmissive display element 115*t* contemporaneously with the 1st image 735 displayed on rear display element 115*r*. Moreover, 4th image 720 is displayed at transmissive display element 115*t* contemporaneously with the 2nd image 740 displayed on rear display element 115*r*. In some implementations, the order of the sequence may vary so that images 720 and 740 are displayed contemporaneously first, followed by a cotemporaneous display of images 705 and 735. In further variations, the cycle shown could be repeated two or more times to reduce potential perceived jitter. For example, if the display system 100 is 240 Hz, and the interleaved content feed comprises 60 images per second, each cycle can be repeated up to 4 times. The display drivers 110 or image generator 105 can interject the repetition.

In variations, other forms of conveying a backlight illumination for transmissive display element 115*t* contemporaneously with the display of 4th image can be utilized. For example, a separate backlight for transmissive display 115*t* may be turned on. In some implementations, the back-light for the transmissive display 115*t* could appear to be a white panel covering the area of interest for display element 115*t*. For example, a white panel can reflect off a partially reflective sheet of glass located between the two display elements 115 to serve as a backlight for 115*t*. In this case, an optional polarizer at the rear face of 115*t* would be used, or a polarized light source. This could serve to allow for a brighter, and potentially a larger or smaller, backlight than that provided by the rear display element 115*r*.

Figure 8:
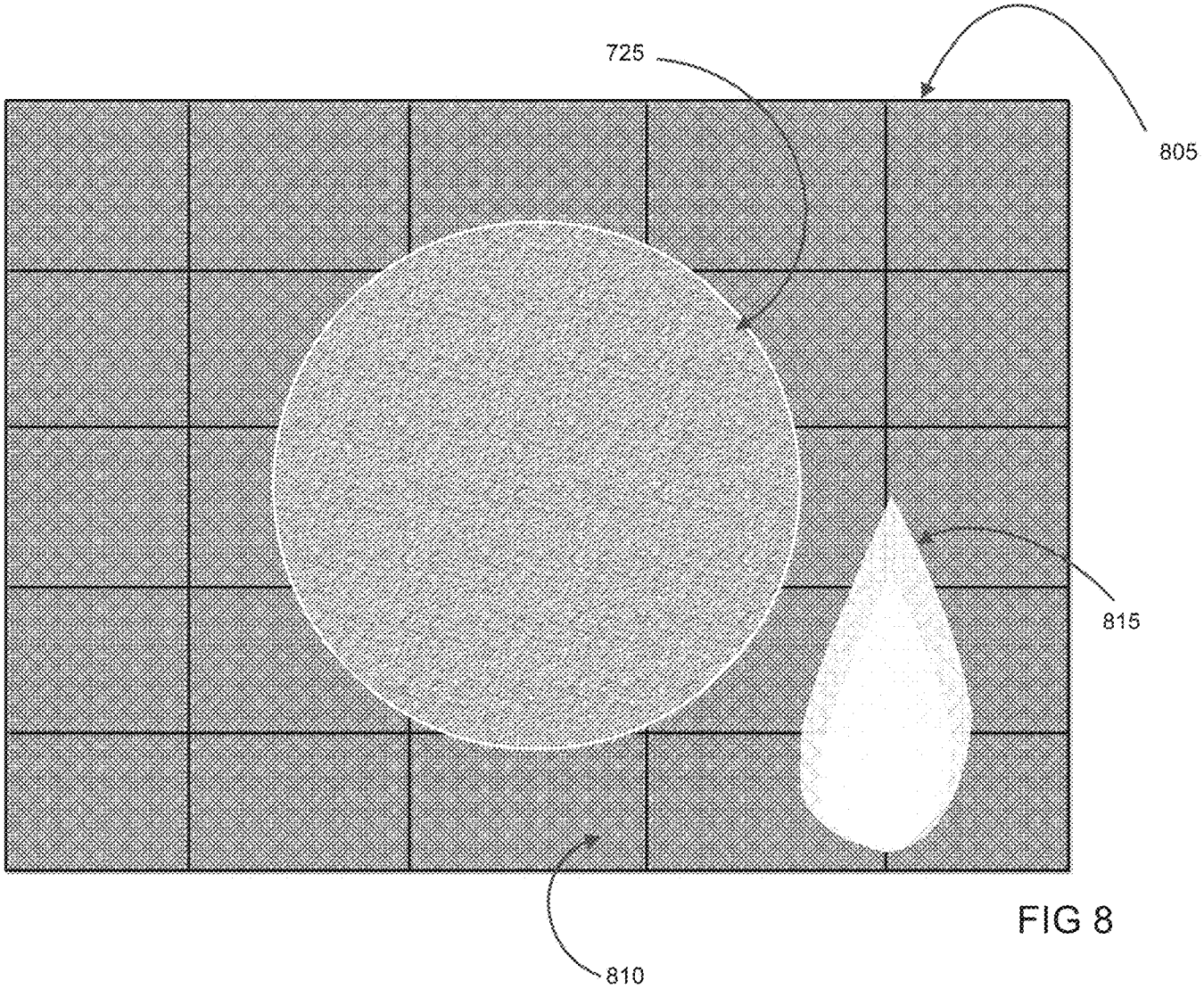
FIG. 8 shows images perceived based on a method of image layering in accordance with an implementation.

FIG. 8 indicates how a viewer 125 can perceive overlaid interleaved images shown in FIG. 7, based on the light path 160 for example. As indicated, the content area 725 can appear opaque, whereas, as indicated at 810, the background image can be visible around the content. In variations, content area 725 can be larger than or different from content mask 710 of FIG. 7, providing additional content that is not masked and thus the additional content being perceived as transmissive in nature. An example of an unmasked content is indicated at 712. Such content can be perceived by a viewer 125, for example, as shown at 815, as a glowing or emissive content.

To further illustrate the results of FIG. 8, referring also to FIG. 7, $3^{rd}$ image 705 can be considered to contain transparency information obtained on the basis of $4^{th}$ image 720. Moreover, it is assumed that in image 705, 0 indicates opaque (e.g black areas of $3^{rd}$ image 705), and 1 indicates transparency, (e.g. white areas of third image 705) with values between 0 and one indicating various states of translucence. In this case, it is assumed that area indicated by 715 has a value of 0.5. The values of each pixel of $3^{rd}$ image 705 will be referred to as Alpha. Alpha value for each color is represented as $\text{Alpha}_R$, for red, $\text{Alpha}_G$, for green and $\text{Alpha}_B$ for blue. Accordingly, the perceived value of a given color for each pixel for one cycle is:

$$rP_R \times \text{Alpha}_R + rW_R * fP_R; \quad \text{(for Red)}$$

$$rP_G \times \text{Alpha}_G + rW_G * fP_G; \quad \text{(for Green)}$$

$$rP_B \times \text{Alpha}_B + rW_B * fP_B; \quad \text{(for Blue)}$$

where rPR is the pixel value for color red of the $1^{st}$ image 735, $rP_G$ is the pixel value for color green of the $1^{st}$ image 735, $rP_B$ is the pixel value for color blue of the $1^{st}$ image 735 (collectively rP), $fP_R$ is the pixel value for color red of the 4th image 730, $fP_G$ is the pixel value for color green of the 4th image 730, $fP_B$ is the pixel value for color blue of the 4th image 730 (collectively fP), $rW_R$ is the pixel value for color red of the $2^{nd}$ image 740, $rW_G$ is the pixel value for color green of the $2^{nd}$ image 740 and $rW_B$ is the pixel value for color blue of the $2^{nd}$ image 740 (collectively rW).

It should be noted that the values for $rW_R$, $rW_G$, and $rW_B$ are equal to 1 since $2^{nd}$ image 740 is white. Accordingly, where Alpha is 0 (opaque, e.g. black in this example) then only the contents of $4^{th}$ image 720 is visible (fP), as indicated at 725 and 815 of FIG. 8. Where Alpha is 0.5 (transmissive in this example, being displayed as a light area, namely an area that is not black) and content is black as indicated at 730, the contents of the $1^{st}$ image 735 is visible, as indicated in FIG. 8 at 810, which in this case is the background since fP is 0 (black). Where Alpha is 1 (translucent), and $4^{th}$ image 720 includes content, such as the flame at 712, the contents of the $1^{st}$ image are added to the contents of the $4^{th}$ image at that pixel (rP+fP), as illustrated in FIG. 8 at the flame 815, which appears glowing or emissive.

Although the previous examples illustrated the case assuming pixel to pixel correlation between the transmissive display element 115*t* and the rear display element 115*r*, in variations, the combinations may be of different pixel or pixels within a vicinity. This may be due to, for example, parallax that arises based on viewer position and angle.

Figure 9:
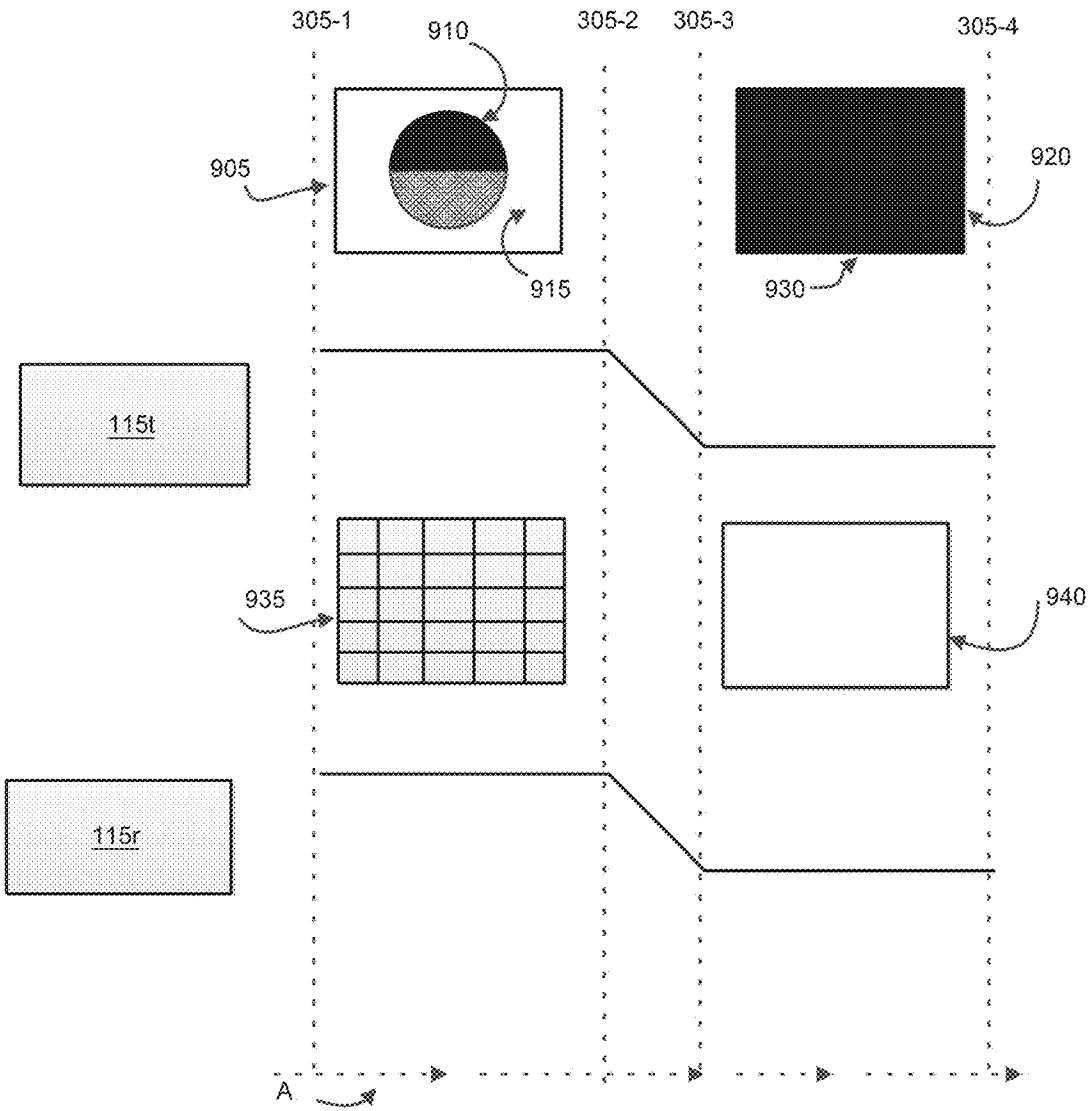
FIG. 9 shows a timeline chart showing a method of image layering in accordance with an implementation.

Referring to FIG. 9, another example of combining layering and interleaving to convey visual effects in a layered display system is shown. As illustrated, a 3rd image 905 and a 4th image 920 are displayed at transmissive display element 115*t* in sequence. The 3rd image 905 includes alpha information and contains a mask area 910, the rest of the third image 905 being a transparent area 915. As indicated in FIG. 9, mask 910 includes both opaque and transmissive components. The 4th image 920 includes content 930, which in this case is black, namely opaque.

Continuing with FIG. 9, a $1^{st}$ image 935 and a 2nd image 940 are displayed at rear display element 115*r* in sequence. 1st image 935 is an image of a background content and second image 940 is an image that enables transmitting a backlight illumination from the rear display element 115*r* to transmissive display element 115*t*.

In this example, the content 930 is opaque. Accordingly, since in this implementation, the transmissive display element 115*t* is a transmissive LCD panel, the content 930 is displayed as black. Moreover, the mask area 910 of $3^{rd}$ image 905 includes both opaque (black) and transmissive (gray) areas. The transparent area 915 of 3rd image 905 is displayed as clear as a result of receiving a white image feed. A person of skill will now recognize that for different types of transmissive displays, different colors may be displayed to achieve opacity and transmissivity.

As indicated in FIG. 9, 3rd image 905 is displayed at transmissive display element 115*t* contemporaneously with the 1st image 935 displayed on rear display element 115*r*. Moreover, 4th image 920 is displayed at transmissive display element 115*t* contemporaneously with the 2nd image 940 displayed on rear display element 115*r*. In some implementations, the order of the sequence may vary so that images 920 and 940 are displayed contemporaneously first, followed by a contemporaneous display of images 905 and 935. In variations, other forms of conveying a backlight illumination for transmissive display element 115*t* contemporaneously with the display of 4th image can be utilized. For example, a separate backlight for transmissive display 115*t* may be turned on.

Figure 10:
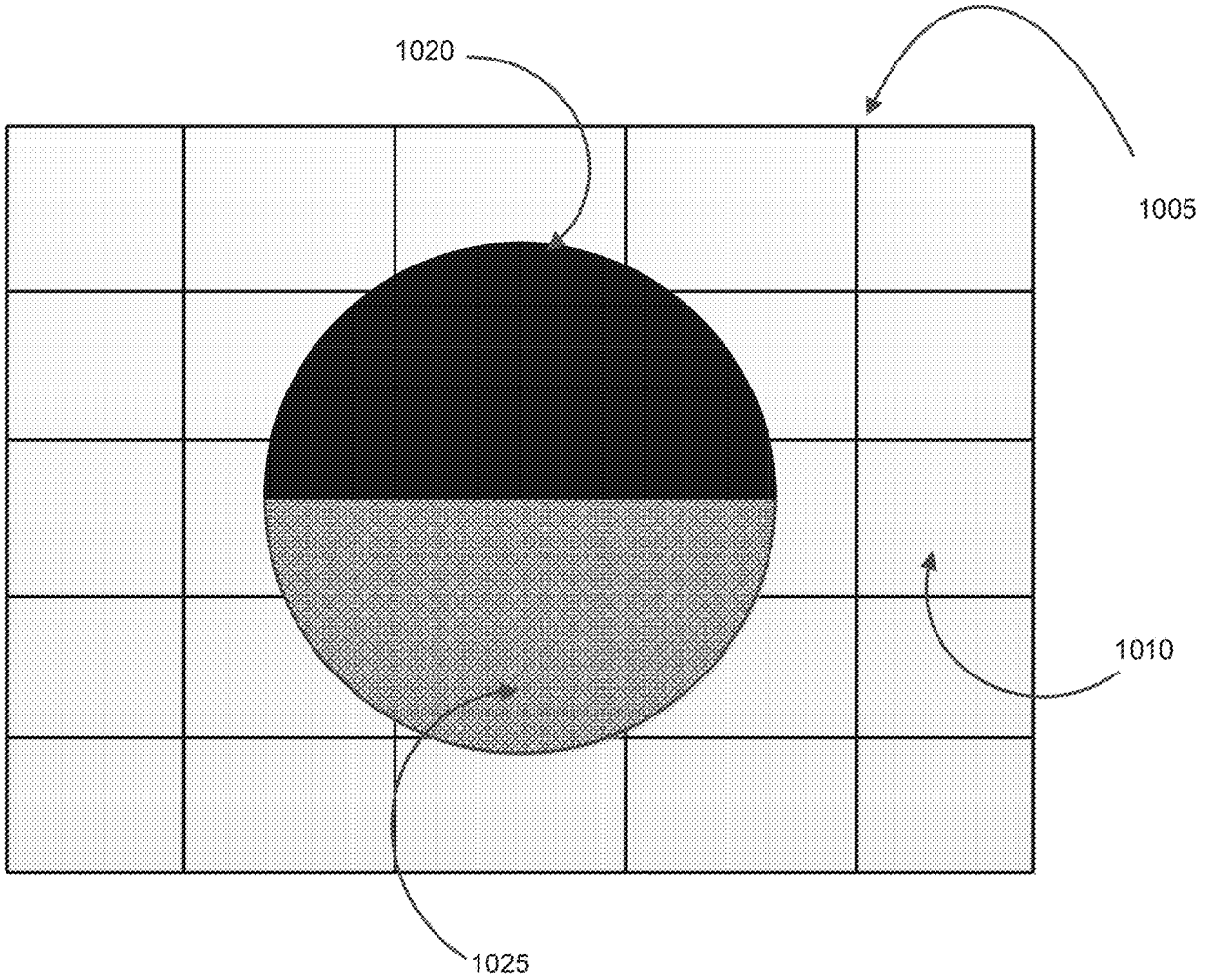
FIG. 10 shows a perceived image based on a method of image layering in accordance with an implementation.

Referring now to FIG. 10, 1005 indicates how a viewer 125 can perceive overlaid interleaved images shown in FIG. 9, based on the light path 160 for example. The black portion 1020 of the mask 910 can appear opaque, not allowing the background image to be visible through it. Content colors other than black, on the other hand, can appear at least partially translucent through which the background is visible, as indicated at the gray portion 1025 of the content. The background image, as indicated at 1010, can be visible around the mask 910.

Figure 11:
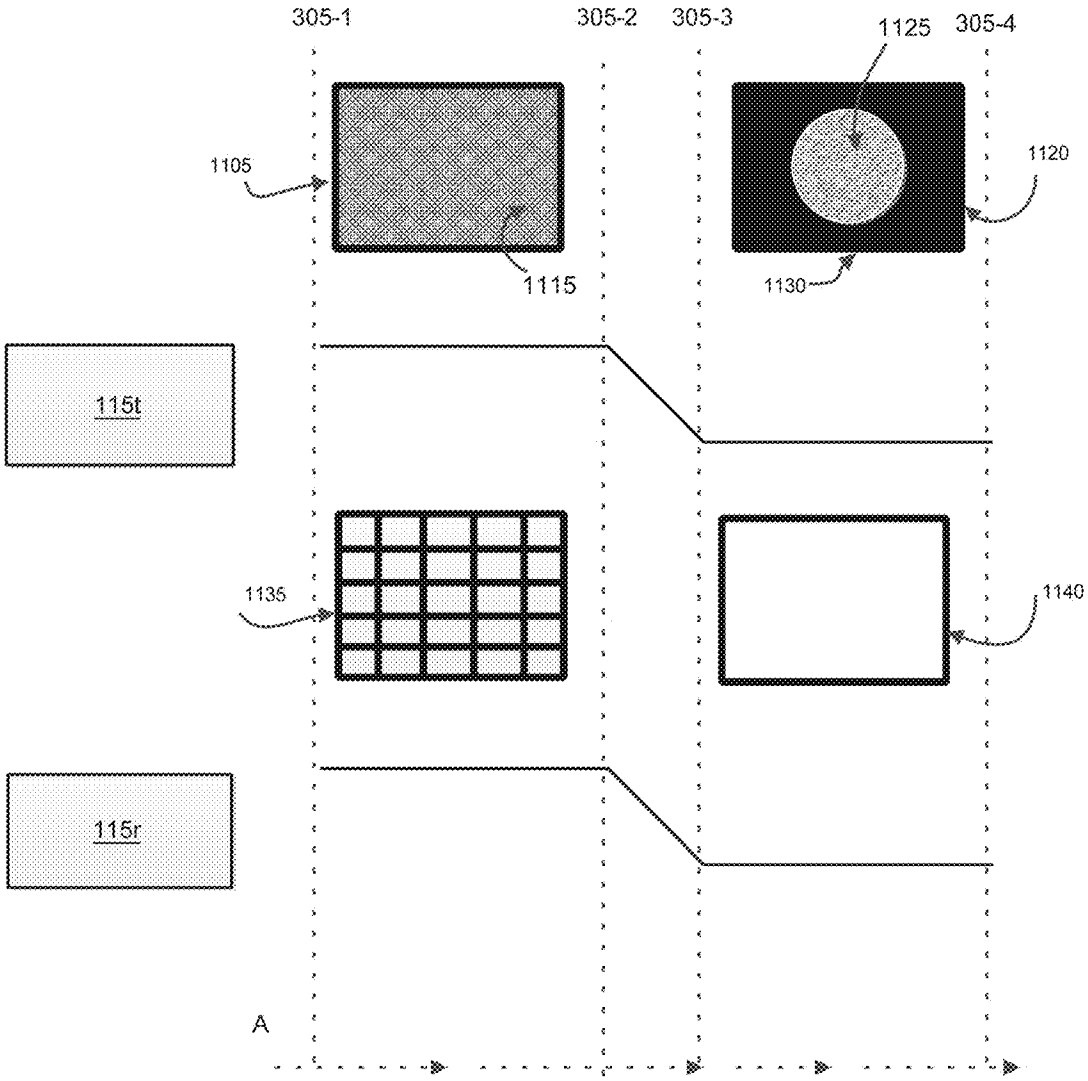
FIG. 11 shows a timeline chart showing a method of image layering in accordance with an implementation.

Referring to FIG. 11, a further example of combining layering and interleaving to convey visual effects in a layered display system is shown. As shown, a 3rd image 1105 and a 4th image 1120 are displayed at transmissive display element 115*t* in sequence. The 3rd image 1105 is a gray area 1115. The 4th image 1120 includes a content area 1125. The rest of the $4^{th}$ image 1120 is a surround mask 1130.

Continuing with FIG. 11, a $1^{st}$ image 1135 and a 2nd image 1140 are displayed at rear display element 115*r* in sequence. 1st image 1135 is an image of a background and second image 1140 is an image that enables transmitting a backlight illumination from the rear display element 115*r* to transmissive display element 115*t*.

In this example, the surround mask 1130 is opaque. Accordingly, since in this implementation, the transmissive display element 115*t* is a transmissive LCD panel, the surround mask 1130 is displayed as black, and the transparent areas of 3rd image 1105 are displayed as clear based on a white image feed. A person of skill will now recognize that for different types of transmissive displays different colors may be displayed to achieve opacity and transparency. The content area 1125 is displayed in accordance with the colors of the content to be displayed in that area.

As indicated in FIG. 11, 3rd image 1105 is displayed at transmissive display element 115*t* contemporaneously with the 1st image 1135 displayed on rear display element 115*r*. Moreover, 4th image 1120 is displayed at transmissive display element 115*t* contemporaneously with the 2nd image 1140 displayed on rear display element 115*r*. In some implementations, the order of the sequence may vary so that images 1120 and 1140 are displayed contemporaneously first, followed by a cotemporaneous display of images 1105 and 1135. In variations, other forms of conveying a backlight illumination for transmissive display element 115*t* contemporaneously with the display of 4th image can be utilized. For example, a separate backlight for transmissive display 115*t* may be turned on.

Figure 12:
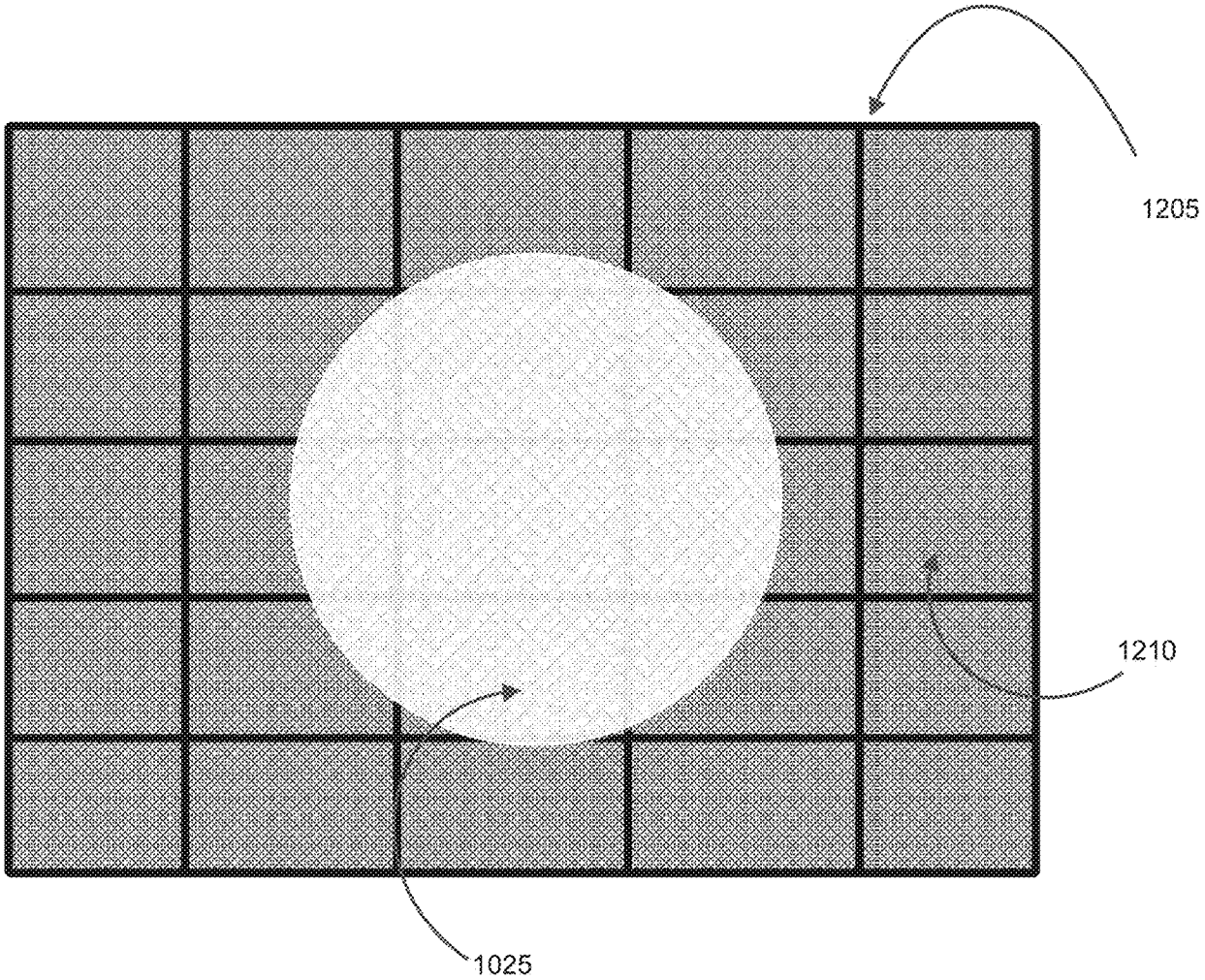
FIG. 12 shows a perceived image based a method of image layering in accordance with an implementation.

Referring now to FIG. 12, 1205 indicates how a viewer 125 can perceive overlaid interleaved images shown in FIG. 11, based on the light path 160 for example. As shown, content 1025 can be perceived as at least partially transmissive, and brighter than the original content 1125, thus being perceived as additive or emissive glowing orb. The background image, as indicated at 1010, can be visible around the content.

Although above examples involve layering and interleaving images having specific combinations of opaque, transparent and transmissive areas, these examples were provided for illustrative purposes only and layering and interleaving of other images having different combinations of opaque, translucent and transparent areas to achieve different perceived effects are possible and within scope.

Figure 13:
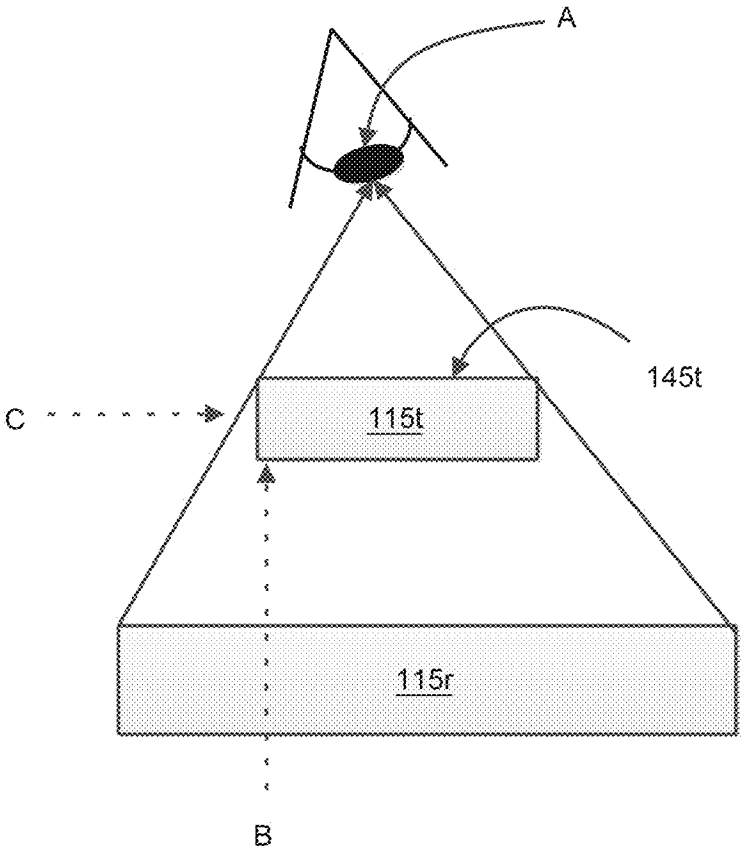
FIG. 13 shows a top view of a block diagram of display elements aligned in accordance with an implementation.

In some implementations, the display elements 115 can have any aspect ratio or shape. In some variations the transmissive display element 115*t* can be sized and positioned with respect to the rear display element 115*r*. For example, referring to FIG. 13, a selected sizing and placement of transmissive display 115*t* is shown as a block diagram from a top view. The transmissive display element 115*t* can be sized and positioned at a depth C, laterally at a point B, and vertically (an axis running in and out of the figure) at a point D (not shown), such that an image displayed at the transmissive display element 115*t*, when viewed from the front surface 145*t* of the translucent display element 115*t*, can remain within the boundaries of the background image that is displayed on the rear display element 115*r* and viewed through the transmissive display element 115*t*. Accordingly, and as indicated at FIG. 13, any image content displayed on transmissive display element 115*t* remains within the bounds of background images displayed at rear display 115*r* when viewed from the view point A, thus ensuring that the content can be masked in its entirety, when a content mask is used, for example in the background images displayed on the rear display element 115*r*. Other manner of sizing and positioning the two display elements 115 will now occur to a person of skill. For example, the display elements 115 can be positioned and sized such that a particular content and its mask remain within the bounds of the background image, regardless of the viewpoint of a viewer. Accordingly, in some variations, the location and the sizing of the two displays can be used to address parallax effects.

In a further variation, a backlight panel surrounding rear display element 115*r* can be used to increase the angles at which content from panel 115*t* can be viewed. In some implementations, surrounding backlight could match closely the brightness of rear display element 115*r*, so as to reduce the differentiation between light generated by displaying white images at rear display element 115*r*, and the surround backlight. In one implementation. The surround backlight would be on when rear display element 115*r* is displaying a white image, and off otherwise.

In variations, layered display systems such as the display system 100 can include additional transmissive display elements. These elements can be layered in front of the transmissive display element 115*t* or in between the two display elements 115. Images displayed on additional elements could include content, opaque and transparent areas as with the other display elements 115 discussed above. The opacity and transparency of the areas can be adjusted such that the image content can serve as background or foreground image as necessary depending on the layering of the additional display elements to achieve the desired transmissiveness.

The layered display systems, such as the example system 100, can be used in various settings. For example, the display system can be used as part of a kiosk or a display case where the background display element 115*r* displays product or service images, and the foreground display element 115*t* provides user interface elements such as graphical user interfaces (GUIs) and/or the image of a concierge explaining the product services of displayed in the background. For example, in a museum, a kiosk containing a layered display element could include images of displayed artifacts and maps of the museum in the background, and a concierge explaining those artifacts and the map as well as user selectable elements in a GUI, in the foreground. The foreground images can be made opaque, translucent, transparent and apparent emissive as appropriate based on the mode of operation. For example, when a user is asked to select which exhibit to get more information about, the concierge image can be made transparent, while the GUI opaque. In variations, objects located between the two elements can also be made visible through appropriate illumination. User selections and interaction in general could be monitored through the use of various devices. For example, the transmissive display element 115*t* could be made capacitive thus registering user touch. Alternatively, one or more optical sensors, such as cameras can monitor viewer movements as gestures and obtain input accordingly. In some implementations the viewer could hold markers or other electronic indicators such as digital markers to assist with the capture and processing of gestures. Additional sensors for capturing viewer location and motion and other modalities such as sound could also be utilized. In other implementations, some objects can be placed between the display elements 115 such that they are visible to a viewer, and images displayed could be used to interact with the objects, such as obtaining information regarding the object, and seeing it in use.

Figure 14:
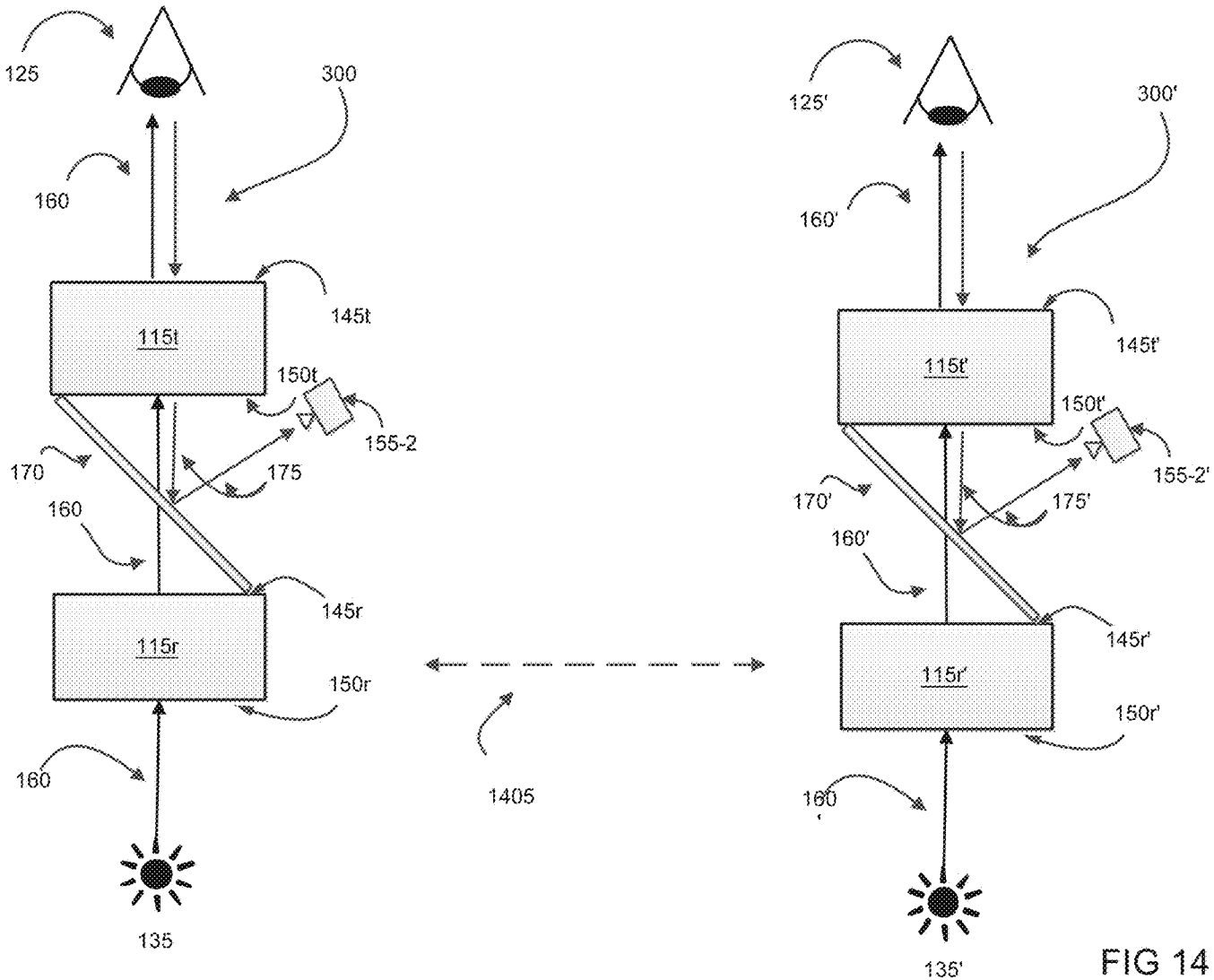
FIG. 14 shows a block diagram of an implementation of two display systems for providing layered images.

In one example use, two display systems can be used as part of a conferencing system. Referring now to FIG. 14, the example display system 300 of FIG. 3 is shown once again in conjunction with a system 300' which is substantially similar to system 300 and represents a second layered display system. In this example, system 300' is in communication with display system 300 as indicated at 1405. The communication could be through wired or wireless connections and could allow the two display systems to connect either directly or through a variety of networks such as local area networks (LANs) or wide area networks (WANs) such as the Internet. The communication allows the exchange of images and other information between the two display systems. The two display systems can be located at different locations.

Continuing with FIG. 14, images of viewer 125 standing in front of the front surface 145*t* of transmissive display element 115*t* could be captured by camera 155-2. In variations, a microphone could also capture sounds within the vicinity of the front surface 145*t*. The captured images (and where applicable sound) could be transmitted to the display system 300'. Once received at the display system 300', the captured images could be displayed on the rear display element 115*r'* or the front display element 115*t'*. Similarly, a camera 155-2' could capture images of a viewer 125' standing in front of the front surface 145*t'* of transmissive display element 115*t'*. In variations, a microphone could also capture sounds within the vicinity of the front surface 145*t*. The captured images (and where applicable sound) could be transmitted to the display system 300. Once received at the display system 300, the captured images could be displayed on the rear display element 115*r* or the front display element 115*t*. Accordingly, video conferencing can be established, where viewer 125 and 125' can converse through the use of the two display systems.

In some variations, gestures made by viewer 125 can also be captured. The gestures can be captured through camera 155-2, another camera 155, touch sensors, digital pen interfaces or other sensors for capturing movement that will now occur to a person of skill. Accordingly, when viewer 125 writes (namely makes gestures akin to writing) on front display element 115' using their finger or fingers, a stylus, a digital pen such as a light pen for example, and other implements that will now occur to a person of skill, the gestures would be captured by the appropriate sensor, and displayed on the transmissive element 115*t*. Thus, it can appear that a viewer 125 can digitally write on the transmissive element 115*t*. In other implementations, a document or some other object could be also displayed on the transmissive panel 115*t*, and thus viewer 125 could apparently digitally annotate the object or the document. Similar capture and display of viewer gestures could also occur at display system 300'. In some implementations, the images displayed at the transmissive display element of the two display systems can be merged. Accordingly, the two viewers can collaboratively share a whiteboard, or annotate documents, for example. The gestures, namely annotations and writings belonging to each viewer can be identified by coloring, dashing or otherwise indicating them differently. In some implementations, each transmissive display element 115*t* can also display content, which is not shared with the other display system. Accordingly, some content such as annotations, documents or GUI can be kept private. In some variations, captured images (and optionally sounds) of each viewer can be displayed on the other viewer's display system, for example at the rear display element 115*r*, allowing viewers to converse with each other while collaboratively sharing annotations, documents, and other content. In some variations, different combinations of layered and interleaved opaque, transparent and translucent image areas can be used to achieve desired opacity or transparency for any of the captured and displayed content, including annotations and documents.

In some implementations, conferencing system of FIG. 300 can involve more than 2 display systems. In these implementations, a canvas between a plurality of displays can be shared, with the rear panel showing a switched view of other displays, e.g. participants. For example, as a participant speaks, their camera inform from that display system can automatically get selected or highlighted as the current view, in some variations being enlarged, for example, to become a primary view. In further variation, some of the participants may not have access to a display system 300, instead participating through a traditional display panel. In these variations, the collaborative display functionality or the remote camera input display functionality can be displayed on the single display panel.

The above-described embodiments are intended to be examples and alterations and modifications may be effected thereto, by those of skill in the art, without departing from the scope which is defined solely by the claims appended hereto. For example, methods, systems and embodiments discussed can be varied and combined, in full or in part.

I claim:

1. A display system for providing layered images comprising:

a rear display element;

a transmissive display element having a front surface and a rear surface, the rear surface placed a predetermined distance from the rear display element such that at least a portion of each of the rear display element and the transmissive display element lie along a light path viewable by a viewer of the display system;

a lighting element including a backlight for the rear display element, the backlight providing backlight illumination to the rear display element and the transmissive display element;

an image generator connected to the rear display element and the transmissive display element; the image generator configured to:

send a background image to the rear display element;

contemporaneously with the background image, send a foreground image to the transmissive display element;

a transmissive sheet placed at an angle between the rear surface of the transmissive display element and a front surface of the rear display element;

a camera having a field of view reflected by the transmissive sheet toward the rear surface of the transmissive display element to capture images, as reflected off of the transmissive sheet, of the viewer located proximal to the front surface of the transmissive display element.

2. The display system of claim 1, further comprising a synchronizer configured to:

synchronize the display of the background and foreground images at the rear display element and the transmissive display element; and synchronize the lighting element with the rear display element and the transmissive display element, such that the lighting element is off during image transitions at the rear display element and the transmissive display element.

3. The display system of claim 2, the synchronizer further configured to:

synchronize the operation of the camera to enable capturing the images while the lighting element is off, and to disable capturing the images while the lighting elements is on.

4. The display system of claim 1, further comprising:

an object placed along the light path, between the rear display element and the transmissive display element, to occlude the background image and the backlight illumination provided to the transmissive display element.

5. The display system of claim 4, further comprising: a further lighting element configured to illuminate the object.

6. The display system of claim 1, the image generator configured to update the foreground image to reflect a viewer gesture detected in the capture images.

7. A method in a display system having a rear display element and a transmissive display element with a front surface and a rear surface, the rear surface placed a predetermined distance from the rear display element such that at least a portion of each of the rear display element and the transmissive display element lie along a light path viewable by a viewer of the display system, the method comprising:

providing backlight illumination to the rear display element and the transmissive display element from a lighting element including a backlight for the rear display element;

at an image generator connected to the rear display element and the transmissive display element:

sending a background image to the rear display element;

contemporaneously with the background image, sending a foreground image to the transmissive display element; and directing a field of view of a camera at a transmissive sheet placed at an angle between the rear surface of the transmissive display element and a front surface of the rear display element, to reflect the field of view toward the rear surface of the transmissive display element;

at the camera, capturing images of the viewer located proximal to the front surface of the transmissive display element.

8. The method of claim 7, further comprising:

synchronizing the display of the background and foreground images at the rear display element and the transmissive display element; and synchronizing the lighting element with the rear display element and the transmissive display element, such that the lighting element is off during image transitions at the rear display element and the transmissive display element.

9. The method of claim 8, further comprising:

synchronizing the operation of the camera to enable capturing the images while the lighting element is off, and to disable capturing the images while the lighting elements is on.

10. The method of claim 7, further comprising:

placing an object along the light path, between the rear display element and the transmissive display element, to occlude the background image and the backlight illumination provided to the transmissive display element.

11. The method of claim 10, further comprising: illuminating the object with a further lighting element.

12. The method of claim 7, further comprising: updating the foreground image to reflect a viewer gesture detected in the capture images.

* * * * *